US009449724B2

(12) United States Patent
Kim

(10) Patent No.: US 9,449,724 B2
(45) Date of Patent: Sep. 20, 2016

(54) STRUCTURE FOR STORING RADIOACTIVE WASTE

(75) Inventor: Jang Hoon Kim, Suwon-si (KR)

(73) Assignee: AJOU UNIVERSITY INDUSTRY-ACADEMIC COOPERATION FOUNDATION, Suwon-Si, Gyeonggi-Do (KR)

( * ) Notice: Subject to any disclaimer, the term of this patent is extended or adjusted under 35 U.S.C. 154(b) by 271 days.

(21) Appl. No.: 14/125,949

(22) PCT Filed: Jun. 13, 2012

(86) PCT No.: PCT/KR2012/004665

§ 371 (c)(1),
(2), (4) Date: Dec. 30, 2013

(87) PCT Pub. No.: WO2012/173388

PCT Pub. Date: Dec. 20, 2012

(65) Prior Publication Data

US 2014/0224677 A1 Aug. 14, 2014

(30) Foreign Application Priority Data

Jun. 13, 2011 (KR) ..... 10-2011-0056867

(51) Int. Cl.

| | |
|---|---|
| ***G21F 3/04*** | (2006.01) |
| ***G21F 5/005*** | (2006.01) |
| ***G21F 1/12*** | (2006.01) |
| ***G21F 3/00*** | (2006.01) |
| ***G21F 7/00*** | (2006.01) |
| ***E04B 1/92*** | (2006.01) |

(52) U.S. Cl.

CPC ..... *G21F 5/005* (2013.01); *E04B 1/92* (2013.01); *G21F 1/12* (2013.01); *G21F 3/00* (2013.01); *G21F 7/00* (2013.01); *E04B 2001/925* (2013.01)

(58) Field of Classification Search

CPC ..... G21F 5/00; G21F 5/002; G21F 5/005; G21F 5/008; G21F 5/012; G21F 5/015; G21F 5/02; G21F 5/06; G21F 5/10

USPC ..... 376/272, 273

See application file for complete search history.

(56) References Cited

U.S. PATENT DOCUMENTS 3,845,315 A * 10/1974 Blum ..... G21F 5/10 250/506.1
3,963,936 A * 6/1976 Lowe ..... G21C 11/024 220/4.12
5,740,215 A * 4/1998 Gluschke ..... G21F 5/10 376/272

(Continued)

FOREIGN PATENT DOCUMENTS

JP 08-029597 A 2/1996
JP 2006-138717 A 6/2006

(Continued)

*Primary Examiner* — Sean P Burke
(74) *Attorney, Agent, or Firm* — Revolution IP, PLLC

(57) ABSTRACT

Disclosed is a nuclear power plant container structure, the structure comprising: a hollow structure having a plurality of cells, each having a hollow portion therein, which are partitioned by cell walls and air-ranged in a three-dimensional pattern so as to form an empty space for sealing and storing the radioactive waste therein; a cladding for surrounding the outside of the hollow structure; and a filler selectively filled into the hollow portions of the cells for suppressing nuclear reactions of the radioactive waste or blocking radioactivity radiated from the radioactive waste.

17 Claims, 14 Drawing Sheets

(56) References Cited

U.S. PATENT DOCUMENTS

| | | | |
|---|---|---|---|
| 5,995,573 | A | 11/1999 | Murray, Jr. |
| 6,802,671 | B1 | 10/2004 | Badie et al. |

FOREIGN PATENT DOCUMENTS

| | | | |
|---|---|---|---|
| JP | 2011-043425 | A | 3/2011 |
| KR | 10-2001-0110462 | A | 12/2001 |

* cited by examiner

STRUCTURE FOR STORING RADIOACTIVE WASTE

CROSS REFERENCE TO PRIOR APPLICATIONS

This application is a National Stage Application of PCT International Patent Application No. PCT/KR2012/004665 filed on Jun. 13, 2012, under 35 U.S.C. §371, which claims priority to Korean Patent Application No. 10-2011-0056867 filed on Jun. 13, 2011, which are all hereby incorporated by reference in their entirety.

TECHNICAL FIELD

The present invention relate to a nuclear power plant container structure, and more particularly, to a nuclear power plant container structure including a plurality of cells arranged in a three-dimensional pattern so as to store and seal radioactive waste.

BACKGROUND ART

In general, the amount of radioactivity of an atomic power plant or of a radioactive waste storage is smaller than that of daily or industrial waste, but since radioactivity has fatal possibility of radioactivity exposure, and a period for treating the same is long, safety in regard to the process of treating radioactivity has to be provided.

An atomic power plant or a radioactive waste storage is built as a concrete structure having multiple blocking walls in order to reduce the influence of radioactivity as much as possible. The blocking walls are formed as sealed containments by using, for example, cement having excellent heat resistance.

However, it has been recently revealed that a hangar which is regarded safe might also collapse under a certain condition, as the example of Japan which was damaged greatly by earthquakes and tsunamis showed. It showed that once a hangar collapses, a nuclear fuel rod is exposed in addition to exposure of radioactivity, and the critical problem of overheating is caused thereby. Moreover, although measures such as inputting cooling water to suppress the overheating of the nuclear fuel rod or inputting a boron solution in order to slow a nuclear reaction have been provided, there is the problem that these measures cost great manpower and vast economic losses.

Thus, the need arises for a structure that stores increasing radioactivity waste safely and thoroughly, and locally restricts the extent of collapse of a hangar even when a condition under which a containment is to necessarily collapse is created due to an earthquake or tsunami, and that delays leakage of radioactivity to thereby reduce the danger as much as possible.

DETAILED DESCRIPTION OF THE INVENTION

Technical Problem

The present invention provides a nuclear power plant container structure that has a reduced weight but appropriate rigidity and strength compared to the reduced weight thereof, and that is capable of safely storing radioactive waste and minimizing damages due to unexpected accidents such as an earthquake or tsunami.

Technical Solution

According to an aspect of the present invention, there is provided a nuclear power plant container structure including: a hollow structure in which a plurality of cells which are hollow and are partitioned by cell walls are arranged in a set, three-dimensional pattern to form inner space for tightly sealing radioactive waste; a cladding for surrounding the outside of the hollow structure; and a filler that is selectively filled in hollow portions of the cells, and suppresses nuclear reactions of the radioactive waste and blocks radioactivity radiated from the radioactive waste.

The filler may include cooling water or a fluid containing boron (Br). The filler may include lead (Pb). The filler may include cooling water or a fluid containing boron (Br) or lead (Pb), and the fluid may be filled in the hollow portions of the cells disposed in an inner portion to be adjacent to the radioactive waste, and the lead (Pb) may be filled in the hollow portions of the cells arranged in an outer portion of the cells filled with the fluid.

The nuclear power plant container structure may further include: a first storage tank that is installed adjacent to the hollow structure, wherein a filler which is the fluid is stored in the first storage tank; and a circulation pump that is connected to the first storage tank and provides a circulation power so that the filler stored in the first storage tank circulates between the hollow portions through the connection hole. The nuclear power plant container structure may further include: a second storage tank that is installed in a remote place from the hollow structure, wherein a filler which is the fluid is stored in the second storage tank; and an emergency supply pump that is connected to the second storage tank and provides an emergency power so that the filler stored in the second storage tank circulates between the hollow portions through the connection hole in an emergency where the circulation pump is not able to operate.

The nuclear power plant container structure may at least one connection hole through which the hollow portions are fluidly connected to one another is formed in the cell walls that form the hollow portions filled with the filler, which is the fluid.

The nuclear power plant container structure may further include: a temperature sensor that senses an internal temperature of the hollow structure; and an ejection nozzle that is installed at an inner wall of the hollow structure, is fluidly connected to the hollow portions of the cells filled with the fluid, and selectively ejects the fluid towards the radioactive waste according to the internal temperature of the hollow structure, sensed by using the temperature sensor.

The nuclear power plant container structure may further include a plurality of tubes inserted into the connection hole.

The hollow structure may be arranged in a three-dimensional pattern in the form of a dome or an arch.

The cells may have a cross-section having a form selected from the group consisting of a circle, an oval, a polygon, and a closed shape formed by combining a curve and a straight line.

The nuclear power plant container structure may further include a plurality of molds that tightly contact the plurality of inner walls of the cells by surface contact. The structure for storing radioactive waste may further include a plurality of connectors that pass through the cell walls to connect and support the plurality of molds.

The molds may be formed of a soft material having flexibility. The molds may be formed of a plastic or an inflated vinyl.

Effect of the Invention

According to the nuclear power plant container structure of the present invention, following effects may be obtained.

Firstly, a hollow structure includes a plurality of cells that are partitioned by cell walls and include hollow portions formed therein, and thus, complicated path for cracks to develop are formed. Accordingly, the extent of damage may be minimized in the case when the hollow structure is damaged due to internal or external impacts.

Secondly, even when the hollow structure collapses due to an earthquake or other impacts, a primary measure of delaying nuclear reactions by allowing a fluid containing boron, which is filled in the cells of a nuclear waste storage container, to pour out, thereby minimizing the damages.

Thirdly, lead is filled in the hollow portions formed by the cell walls, thereby effectively blocking radioactivity.

Fourthly, the fluid containing boron, filled in the hollow portions of the cells, is circulated by using a pump, thereby additionally obtaining a cooling effect.

Fifthly, even when a portion of the hollow structure collapses due to an earthquake or other impacts, cooling water and a fluid for delaying nuclear reactions may be continuously supplied from a remote place where the influence of radioactivity is small.

BEST MODE

Hereinafter, preferred embodiments of the present invention will now be described with reference to the attached drawings.

Figure 1:
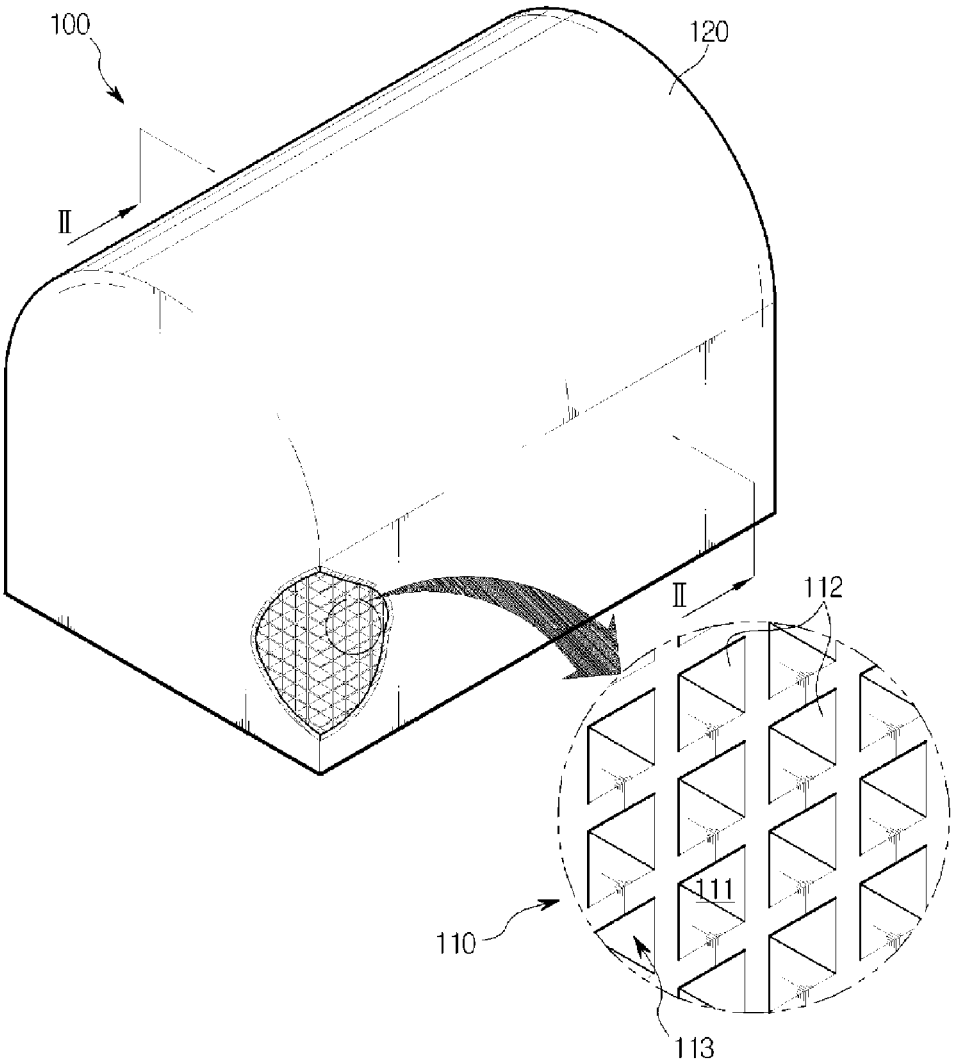
FIG. 1 is a partially cutaway perspective view of a nuclear power plant container structure according to an embodiment of the present invention.
Figure 2:
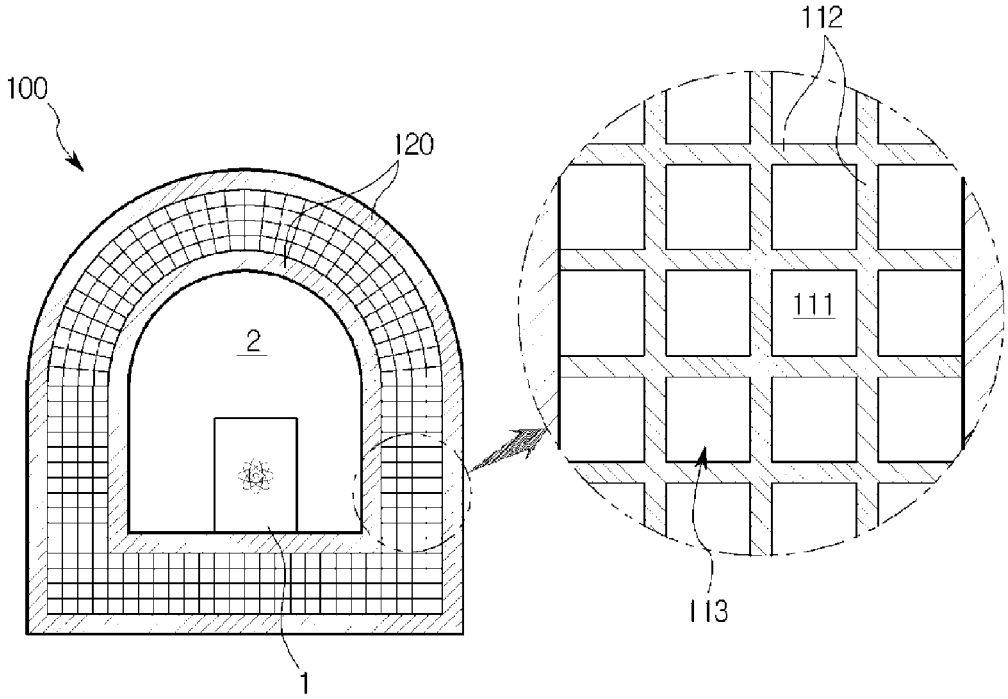
FIG. 2 is a cross-sectional view of FIG. 1 cut along a line II-II.
Figure 3:
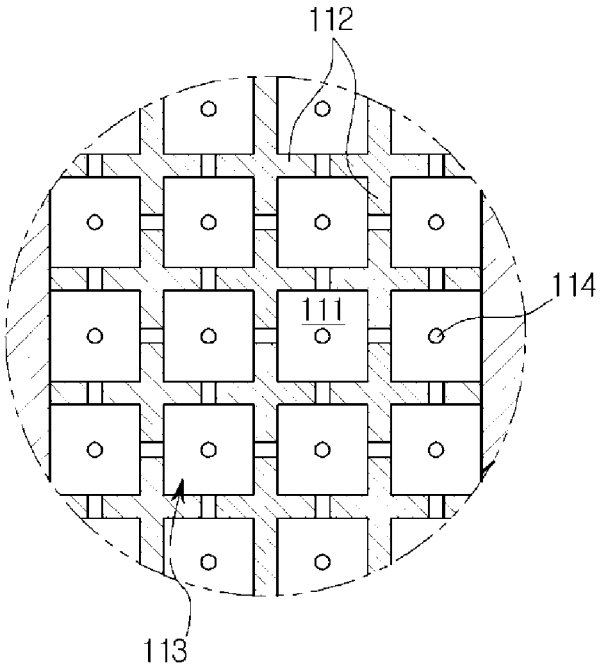
FIG. 3 is a cross-sectional view illustrating a state in which a connection hole is formed in a hollow structure illustrated in FIG. 2.
Figure 4:
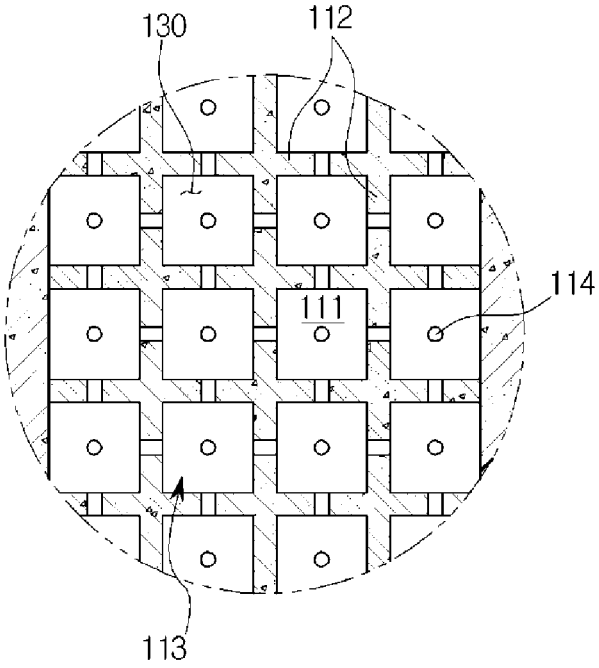
FIG. 4 is a cross-sectional view illustrating a fluid filled in cells illustrated in FIG. 3.
Figure 5:
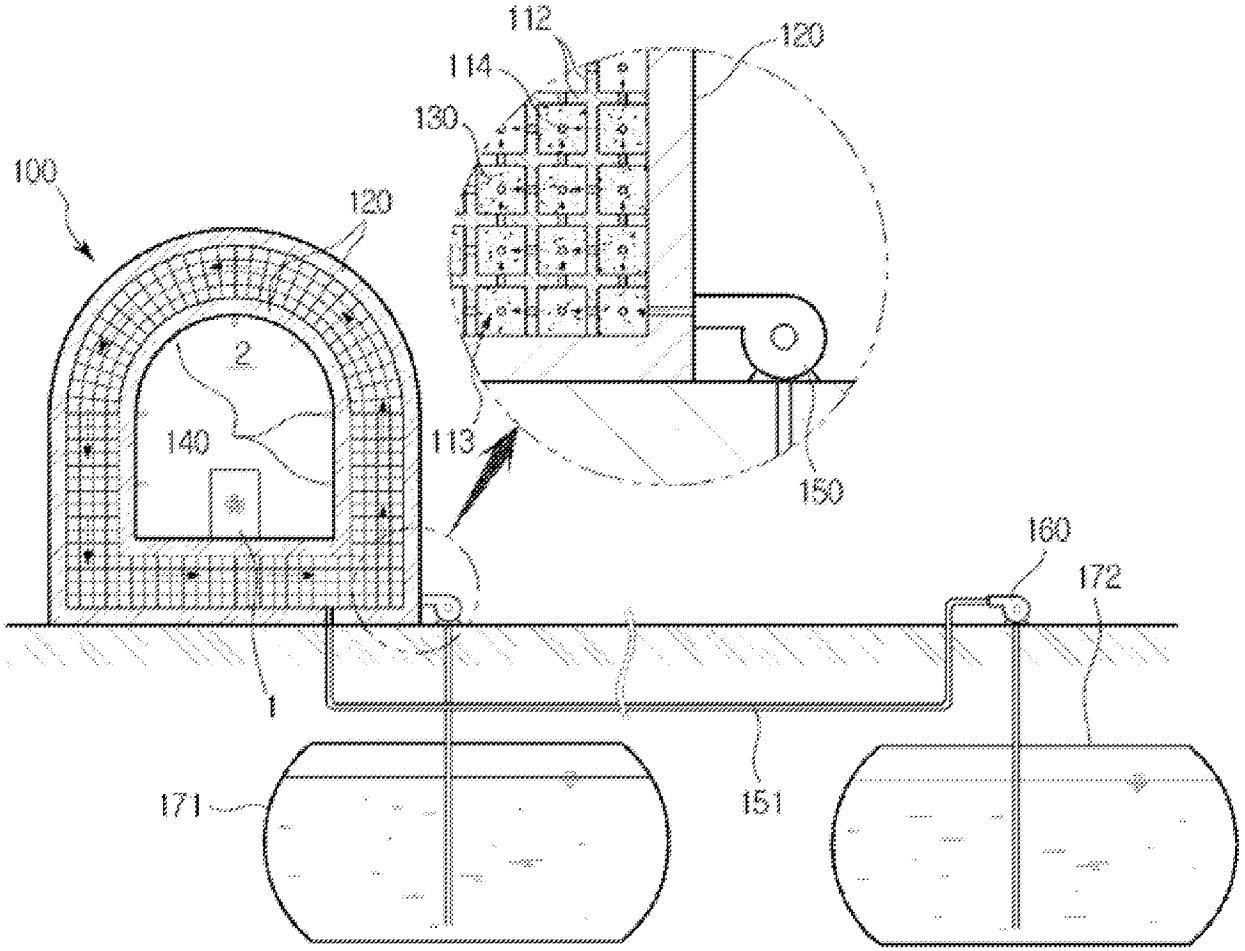
FIG. 5 is a structural diagram illustrating a state in which a fluid is circulated between hollow portions illustrated in FIG. 1 by using a pump.

FIG. 1 is a partially cutaway perspective view of a nuclear power plant container structure according to an embodiment of the present invention. FIG. 2 is a cross-sectional view of FIG. 1 cut along a line II-II. FIG. 3 is a cross-sectional view illustrating a state in which a connection hole is formed in a hollow structure illustrated in FIG. 1. FIG. 4 is a cross-sectional view illustrating a fluid filled in cells illustrated in FIG. 3. FIG. 5 is a structural diagram illustrating a state in which a fluid is circulated nuclear power plant container structure illustrated in FIG. 1 by using a pump.

Referring to FIGS. 1 through 5, the nuclear power plant container structure 100 (hereinafter abbreviated as a storage structure 100) includes a hollow structure 110, a cladding 120, and a filler 130.

The hollow structure 110 includes cells 112 that are arranged in a three-dimensional pattern to form inner space 2 for sealing and storing radioactive waste 1 therein. In the hollow structure 110, the cells 112 are arranged along a curve so that an upper portion of the hollow structure 110 has an arch shape, and the entire hollow structure 110 including its bottom part is tightly sealed. The overall shape of the hollow structure 110 is a dome shape or an arch shape. However, the shape of the hollow structure 110 is not limited thereto, and as long as the hollow structure 110 includes the inner space 2 and performs the function of tightly sealing an inner portion thereof, the hollow structure 110 may also have a hexahedral or polyhedral shape. As will be described later with reference to a method of manufacturing the storage container 100, the hollow structure 110 includes a plurality of cells 112 that are partitioned by cell walls 113. The plurality of cells 112 are arranged in a set, three-dimensional pattern. That is, the cell walls 113 are arranged in length, height, and width directions to form hollow portions 111. As the plurality of cells 112 are arranged in a three-dimensional pattern, may effectively resist forces working in each direction, and accordingly, damages due to cracks or impacts may be locally and stably restricted.

In FIGS. 1 and 2, the cell walls 113 that partition the plurality of cells 112 and are formed as a single unit are illustrated. Also, a method of manufacturing the storage container 100 according to an embodiment of the present invention, which will be described later, includes an operation of forming the inner walls 113 as a single unit. However, forming the inner walls 113 as a single unit is exemplary, and the nuclear power plant container structure 100 for storing radioactive waste, which is formed as a huge structure, may also be manufactured in situ. This will be described in detail later. The cells 112 may be arranged, for example, in a matrix. However, a method of arranging the cells 112 is not limited to a matrix, and the cells 112 may be arranged in other various manners. Also, the cell walls 13 that partition the cells 112 may be formed of any material as long as the cell walls 113 may structurally maintain a stress. Also, according to necessity, the cell walls 113 may be formed of a stiffener such as a reinforcing bar or a reinforcing fiber that is arranged for reinforcement. Moreover, as illustrated in FIG. 3, at least one connection hole 114 through which the hollow portions 111 formed in the cells 112 may be fluidly connected to one another may be formed in each of the cell walls 113. The connection hole 114 is formed in each of the cell walls 113 when casting the hollow structure 110, as a result of inserting a pin or an annular tube (not shown) between molds which are to be described later. Also, the pin or the tube inserted into the connection hole 114 has the function of supporting a frame which is used in forming the hollow portions 111. Also, the pin or the tube may function as path through which the hollow portions 111 are filled with a fluid 130 (see FIG. 4). Here, although one connection hole 114 formed in each of the cell walls 113 is illustrated, this is exemplary, and a plurality of connection holes 114 may also be formed according to necessity.

The cladding 120 surrounds the outside of the hollow structure 110. The cladding 120 may be formed of any material as long as the cladding 120 may structurally maintain a stress. That is, the cladding 120 may be formed of, for example, concrete, a ceramic, a synthetic material, or a metal. Alternatively, the cladding 120 may be formed of a plurality of panels having a finishing function; in this case, the panels are integrally coupled without any gap, according to the form of the hollow structure 110 outside the hollow structure 110 in each direction. In addition, the cladding 120 may be formed of various materials that form the outside of the hollow structure 110. According to necessity, the cladding 120 may be formed of a stiffener such as a reinforcing bar or a reinforcing fiber that is arranged for reinforcement.

The filler 130 is selectively filled in the hollow portions 111 of the cells 112. The filler 130 suppresses nuclear reactions of the radioactive waste 1 or blocks radioactivity radiated from the radioactive waste 1.

The filler 130 may be a fluid 130 as illustrated in FIG. 4. The fluid 130 may be a functional material that slows nuclear reaction of nuclear materials, and may be, for example, cooling water or boron (Br), but is not limited thereto. It should be interpreted here that any fluid that is capable of slowing nuclear reactions may be used as the fluid 130. The fluid 130 is dropped onto the radioactive waste 1 when the storage container 100 is damaged, and in this regard, the fluid 130 may have great significance as an initial stage measure for suppressing primary nuclear reactions of the radioactive waste 1. In detail, even when the storage structure 100 collapses due to an earthquake or external impacts, the fluid 130 covers the radioactive waste 1 so as to minimize leakage of radioactivity, thereby preventing even greater damages. However, not only the fluid 130 but also a liquid or a gas containing a functional additive may be filled in the hollow portions 111 according to necessity. That is, while the fluid 130 may be filled in the hollow portions 111 of the cells 112 through the connection hole 114 described above, this method is exemplary, and the embodiments of the present invention are not limited thereto.

Figure 6:
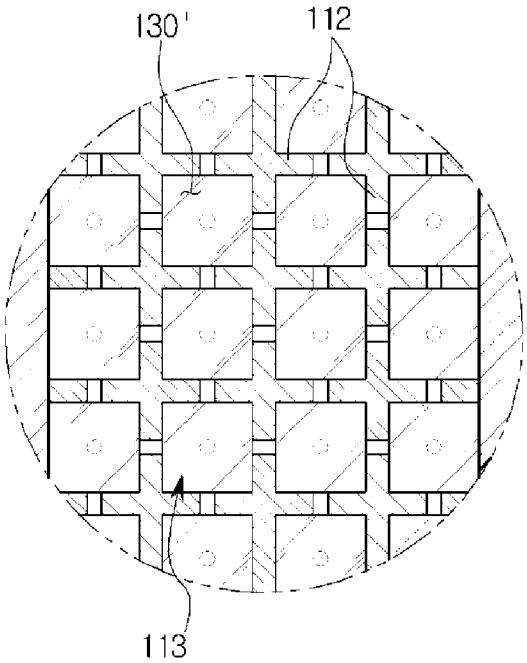
FIG. 6 is a cross-sectional view illustrating in which lead is filled in the cells illustrated in FIG. 3.

As an alternative of the fluid 130, FIG. 6 illustrates an example where lead 130' is filled in the cells that form the hollow portions are formed. Here, like reference numerals as those of FIGS. 1 through 5 denote like elements that have the same structure and perform the same function, and thus, repeated description thereof will be omitted.

Referring to FIG, the lead 130' is filled in each of the hollow portions 111 of the cells 112. The lead 130' is filled in the hollow portions 111 of the cells 112 at normal times so as to thoroughly block leakage of radioactivity to the outside. As illustrated in FIG. 6, the lead 130' is filled in the hollow portions 111 of the cells 112, but this is exemplary, and the lead 130' may also be filled in the hollow portions 111 of the cells 112 in which the connection hole 114 is formed.

Figure 7:
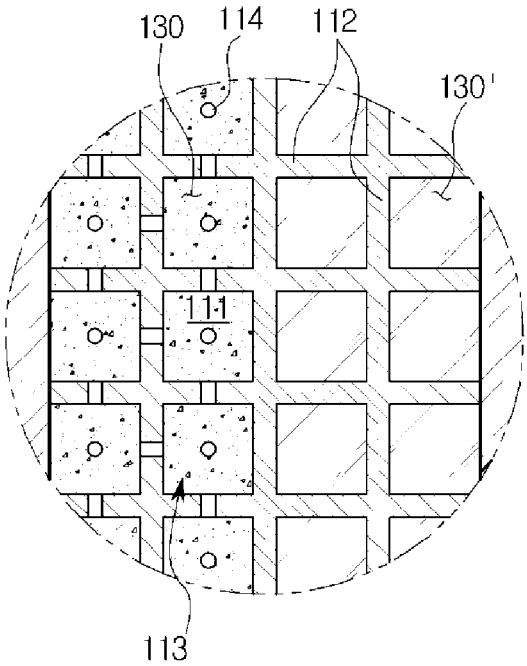
FIG. 7 is a cross-sectional view illustrating adjacent cells in the nuclear power plant container structure, filled with a filler, and lead filled in an outer portion of the cells that are filled with the fluid, illustrated in FIG. 3.

Alternatively, FIG. 7 is a cross-sectional view illustrating an example where the fluid 130 is filled in predetermined adjacent cells 112 in an inner portion of in the storage structure 100, and the lead 130' is filled in an outer portion of the cells 112 that are filled with the fluid 130. Here also, like reference numerals as those of FIGS. 1 through 6 denote like elements that have the same structure and perform the same function, and thus, repeated description thereof will be omitted.

Referring to FIG, the fluid 130 is filled in each of the hollow portions of the cells 112 placed in the inner portion of the hollow structure 110 to be adjacent to the radioactive waste 1, and the lead 130' is filled in each of the hollow portions 111 in an outer portion of the cells 112 that are filled with the fluid 130. When the storage container 100 collapses due to an earthquake or other external impacts, first, the fluid 130 is poured from the adjacent cells 112 of the inner portion onto the radioactive waste 1. Consequently, nuclear reactions of the radioactive waste 1 are delayed primarily. At least one connection hole 114 through which the hollow portions 111 formed in the cells 112 are fluidly connected to one another may be formed in each of some of the cell walls 113. The connection hole 114 performs the function of fluidly connecting the hollow portions 111 filled with the fluid 130. However, this is exemplary, and the connection hole 114 may also be formed in each of the cell walls 113 as illustrated in FIG. 6. Repeated description of the connection hole 114 will be omitted here.

Figure 8:
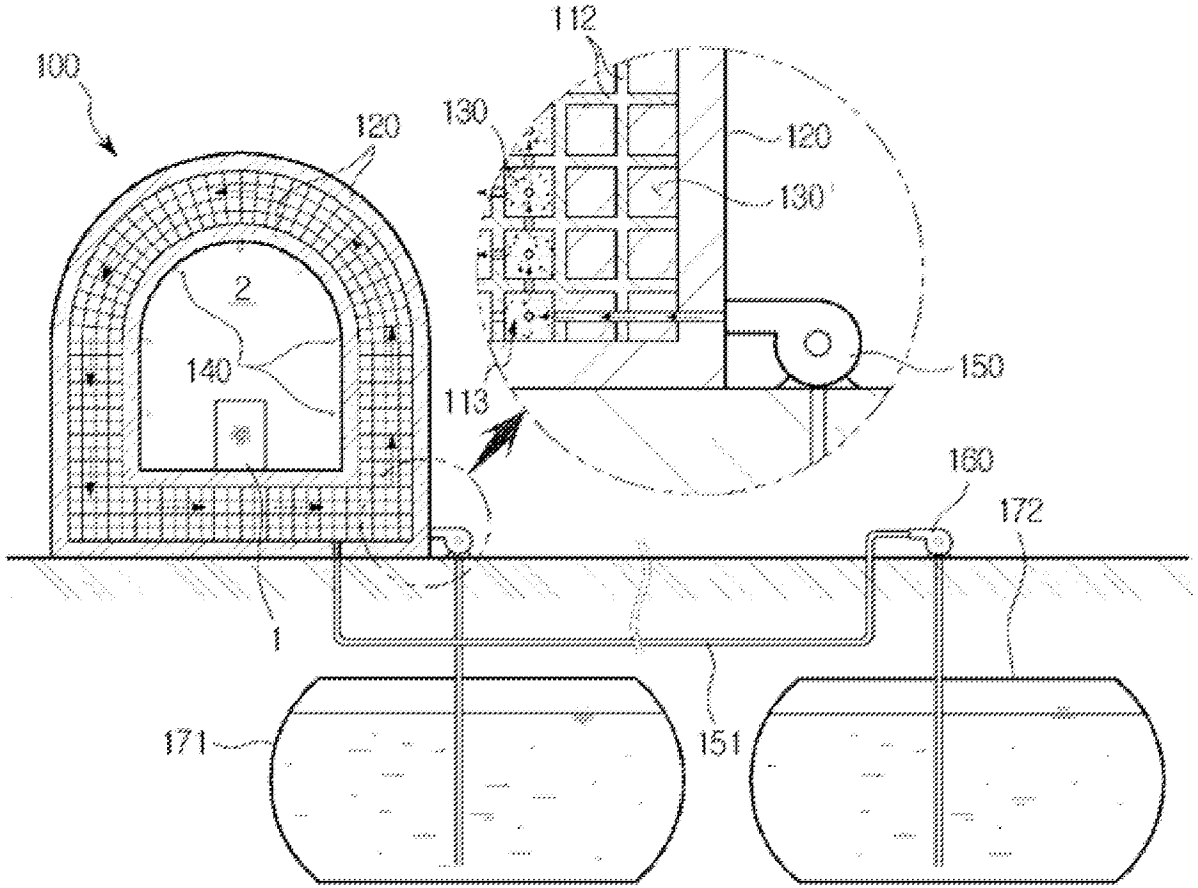
FIG. 8 is a structural diagram illustrating a state in which a fluid in the cells of an inner portion adjacent to radioactive waste is circulated by using a pump illustrated in FIG. 7.

As described above, the nuclear power plant container structure 100 according to the current embodiment of the present invention may further include a first storage tank 171 and a circulation pump 150 as illustrated in FIGS. 5 and 8.

The first storage tank 171 is installed adjacent to the hollow structure 110, and stores the filler 130 which is the fluid, and may preferably be laid under the ground typically.

The circulation pump 150 is connected to the first storage tank 171, and provides a circulation power so that the filler 130 may circulate between the hollow portions 111 through the connection hole 114. The circulation pump 150 may be installed outside the hollow structure 110 but this is exemplary, and may also be installed inside the hollow structure 110. Also, while the circulation pump 150 installed on the ground is illustrated, the circulation pump 150 may also be laid under the ground. Also, a plurality of circulation pumps 150 may be installed.

According to the current embodiment of the present invention as described above, the nuclear power plant container structure 100 may preferably further include a second storage tank 172 and an emergency supply pump 160.

The filler 130 which is the fluid is stored in the second storage tank 172. The second storage tank 172 is installed in a remote place from the hollow structure 110. In detail, the remote place means a distance that is sufficiently away so that an operator may safely operate from the danger of exposure caused by radioactive waste even in an emergency where the nuclear power plant container structure 100 collapses. While the second storage tank 172 is laid under the ground in the drawings, this is exemplary, and the second storage tank 172 may also be installed on the ground. However, a pipeline or a flexible hose that connects the second storage tank 172 and the connection hole 114 of the hollow structure 110 may preferably be laid under the ground.

The emergency supply pump 160 is connected to the second storage tank 172. The emergency supply pump 160 provides emergency power to allow the filler 130 filled in the second storage tank 172 to circulate between the hollow portions 111 through the connection hole 114 in an emergency where the nuclear power plant container structure 100 collapses due to an earthquake or tsunami and thus is not able to operate.

In addition, the emergency supply pump 160 supplies the fluid 130 safely against situations where power supply is stopped due to, for example, a power failure, and the circulation pump 150 is not able to operate normally. Moreover, the emergency supply pump 160 has an important function of continuously supplying the fluid 130 by using the hose 151, even when the storage container 100 collapses due to an earthquake or tsunami or the like. Meanwhile, while one emergency supply pump 160 is included in FIGS. 5 and 8, this is exemplary, and a plurality of emergency supply pumps 160 may be included according to necessity.

Meanwhile, the nuclear power plant container structure 100 according to the current embodiment of the present invention may further include a temperature sensor (not shown) and an ejection nozzle 140 as illustrated in FIGS. 5 and 8.

Although not illustrated in the drawings, the temperature sensor senses an internal temperature of the hollow structure 110. The ejection nozzle 140 is installed at an inner wall of the hollow structure 110, and is fluidly connected to the hollow portions 111 of the cells 112 filled with the fluid 130. A plurality of ejection nozzles 140 may also be included, and may be arranged at predetermined intervals. The ejection nozzle 140 may selectively eject the fluid 130 towards the radioactive waste 1 according to the internal temperature of the hollow structures 110 sensed by using the temperature sensor.

In detail, if power supply is suddenly stopped due to an external factor such as a power failure, and the internal temperature of the ejection nozzle 140 reaches a predetermined level, the temperature sensor starts operating. Then, the fluid 130 is ejected onto an inner portion of the storage structure 100 through the ejection nozzle 140. Accordingly, overheating of the radioactive waste 1, which is caused by interruption of a system as the inner portion of the storage container 100 abnormally operates, may be effectively prevented by using the ejection nozzle 140.

Meanwhile, while the cells 112 that form the hollow structure 110 in a three-dimensional pattern and have a rectangular cross-section are illustrated in FIGS. 1 through 8, this is exemplary, and the cells 112 may have various forms.

Figure 9:
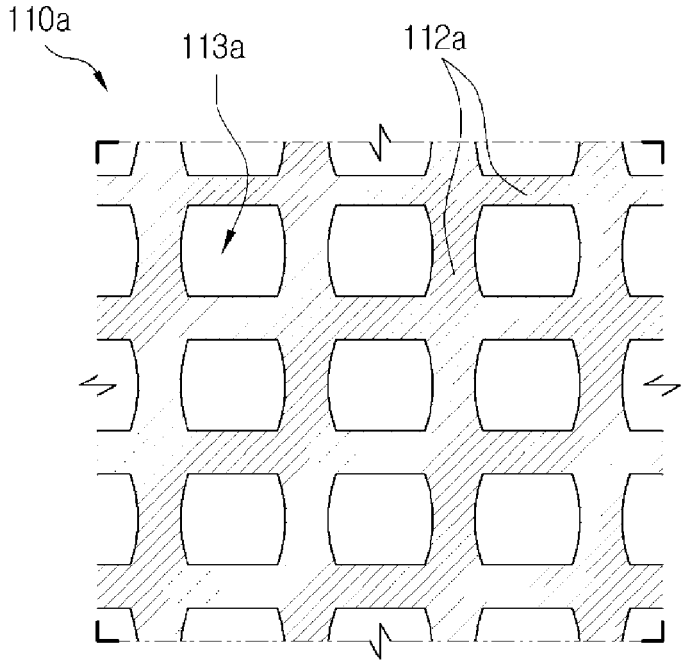
FIGS. 9 through 11 are cross-sectional views illustrating cells of a hollow structure illustrated in FIG. 1 according to another embodiments of the present invention.
Figure 10:
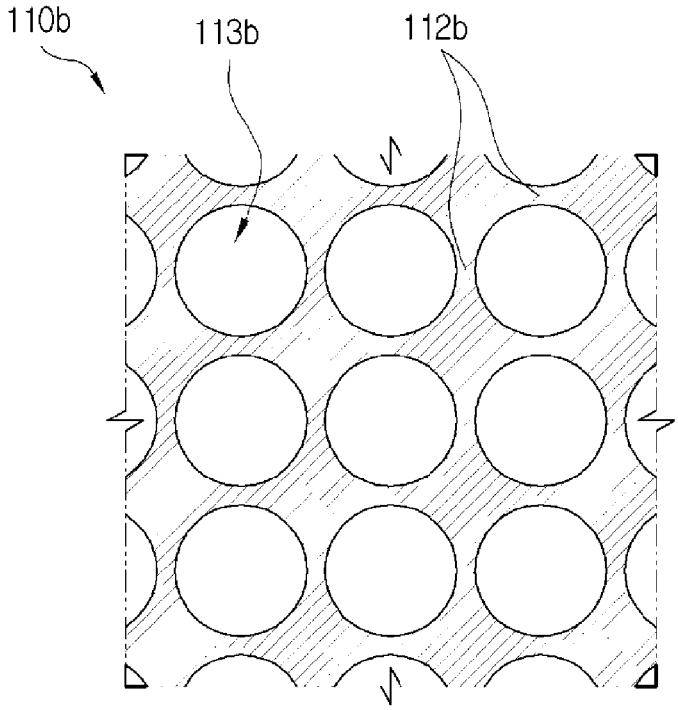
Figure 11:
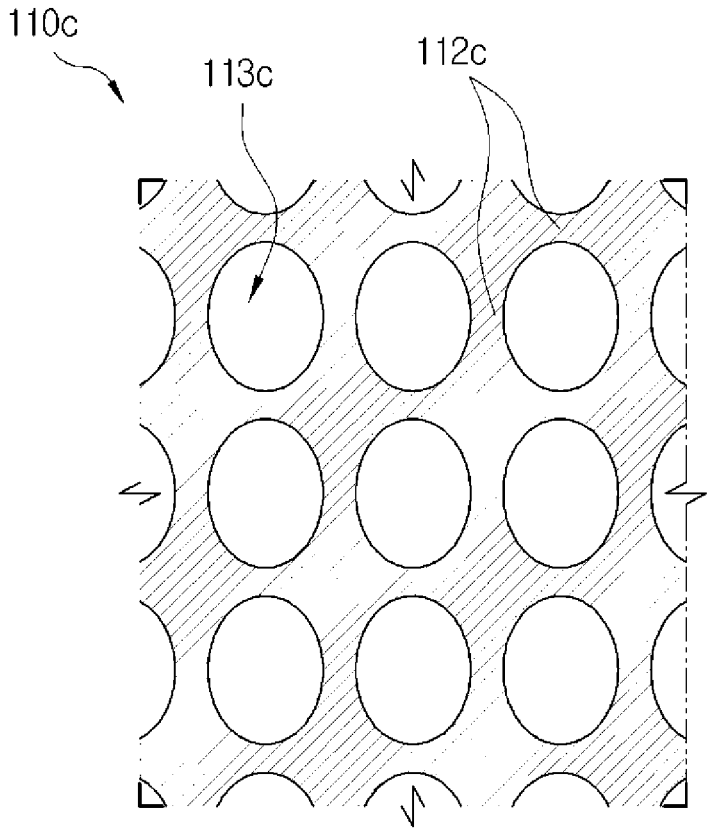

FIGS. 9 through 11 illustrate cells 112*a*, 112*b*, and 112*c* that respectively form hollow structures 110*a*, 110*b*, and 110*c* according to another embodiments of the present invention. Here, FIGS. 9 through 11 respectively illustrate the cells 112*a*, 112*b*, and 112*c* that form the hollow structure 110 illustrated in FIG. 1 according to another embodiments of the present invention.

As described above, the cells 112 that form the hollow structure 110 may have not only a polygonal cross-section such as a rectangle but also a form formed by a smooth curved line. Moreover, as illustrated in FIG. 9, a cross-section of the cells 112*a* may be a closed shape formed by combining a curved line and a straight line. Also, as illustrated in FIGS. 10 and 11, the cells 112*b* and 112*c* may be a circle (see FIG. 10) and an oval (see FIG. 11), respectively. The shapes of the cross-sections of the cells 112 (112*a*, 112*b*; and 112*c*) provide broad inner space and make complicated development paths for cracks at the same time. Thus, if the structure is damaged due to an impact caused by internal and external factors, the extent of damage may be minimized.

Hereinafter, a method of manufacturing the storage container according to an embodiment of the present invention will be described with reference to the attached drawings.

Figure 12:
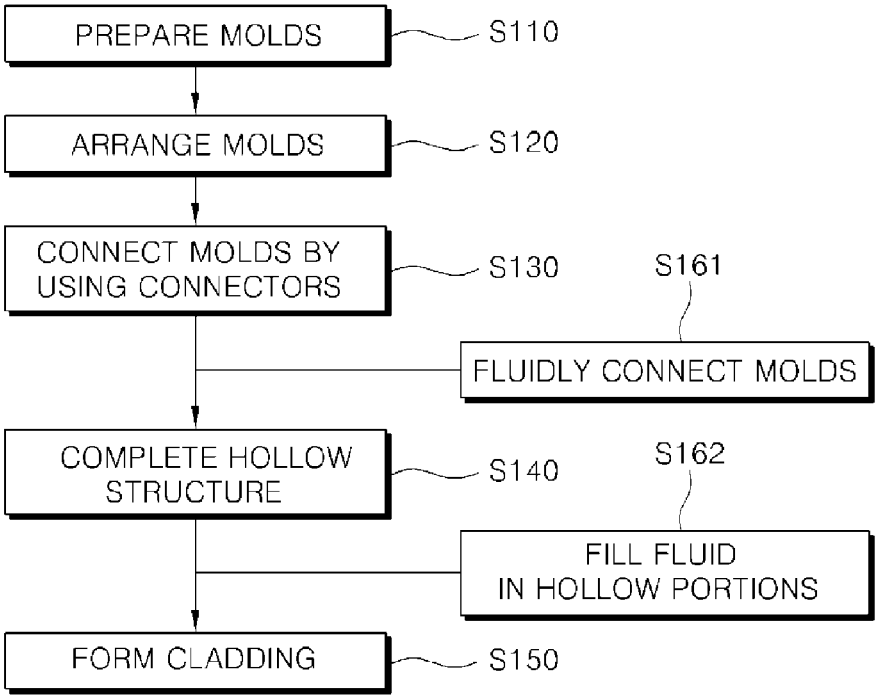
FIG. 12 is a flowchart of a method of manufacturing a nuclear power plant container structure according to an embodiment of the present invention.
Figure 13:
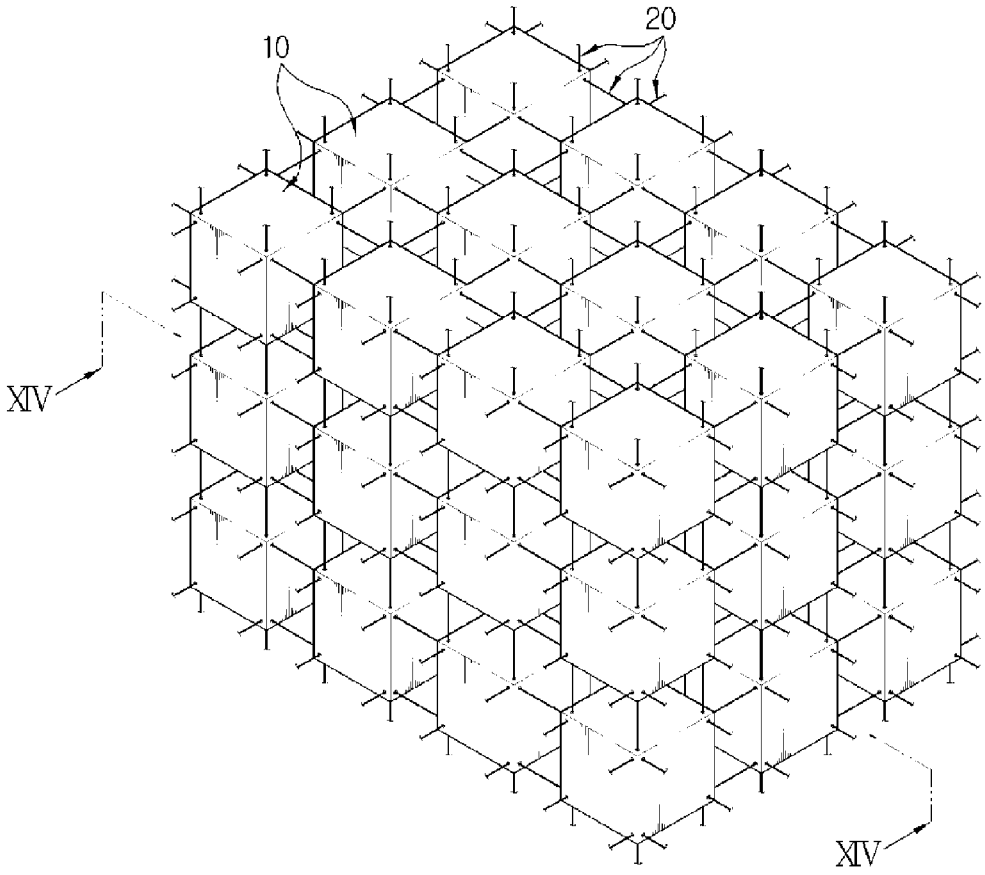
FIG. 13 is a perspective view illustrating the method of manufacturing a nuclear power plant container structure of FIG. 12.
Figure 14:
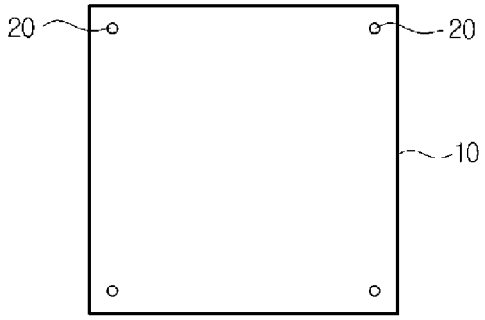
FIG. 14 is a cross-sectional view cut along a line XI-XI of FIG. 13.
Figure 17:
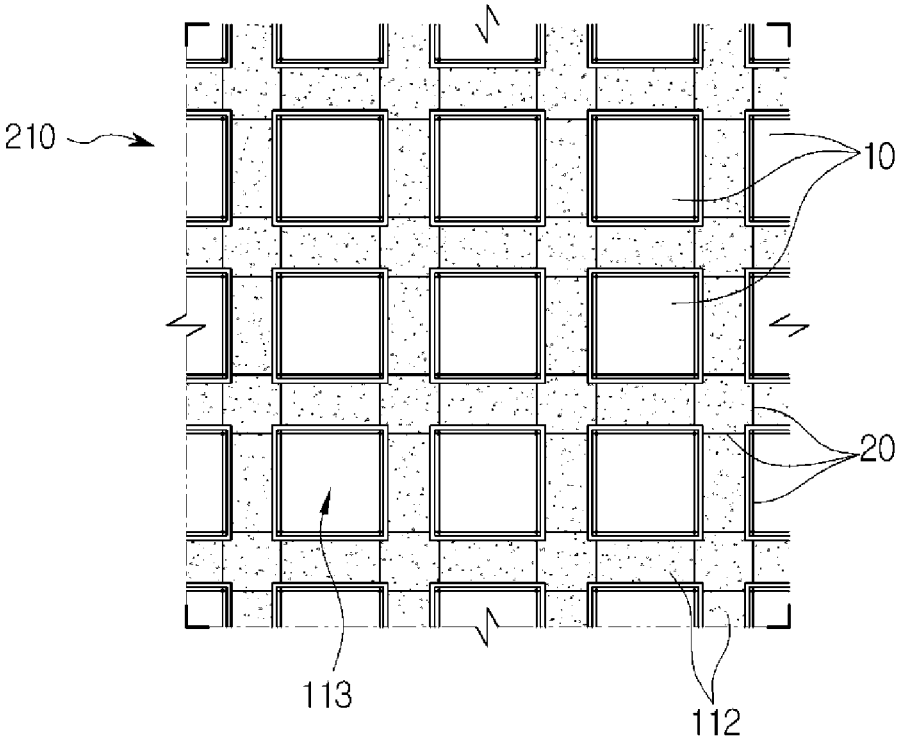
FIG. 17 is a cross-sectional view of a nuclear power plant container structure according to another embodiment of the present invention, which is manufactured by using the method of manufacturing illustrated in FIGS. 13 and 14.

FIG. 12 is a flowchart of a method of manufacturing a storage structure 100 according to an embodiment of the present invention. FIG. 13 is a perspective view illustrating the method of manufacturing the storage structure 100 of FIG. 12. FIG. 14 is a cross-sectional view cut along a line XVI-XVI of FIG. 13. FIG. 17 is a cross-sectional view of a nuclear power plant container structure according to another embodiment of the present invention, which is manufactured by using the method of manufacturing illustrated in FIGS. 13 and 14. Here, like reference numerals as in those of FIGS. 1 through 8 denote like elements that have the same structure and perform the same function, and thus repeated description thereof will be omitted.

In addition, in regard to the method of manufacturing the storage container 100, a hollow structure 110 having a rectangular parallelepiped shape will be described for the purpose of description of the method is to describe a method of manufacturing (the storage container 100?) in which the plurality of cells 112 are arranged three-dimensionally.

As illustrated in FIGS, in order to manufacture the storage container 100 according to the current embodiment of the present invention, first, a plurality of molds 10 having an external shape corresponding to the hollow portions 111 formed in the cells 112 included in the hollow structure 110, which is to be completed, are prepared in operation S110.

The molds 10 may preferably be formed of a soft material having flexibility so that the molds 10 do not greatly affect rigidity of the cell walls 113. For example, the molds 10 may be formed of a plastic or an inflated vinyl, but is not limited thereto. Also, as described above, the hollow portions 111 formed in the cells 112 may have various shapes including a hexahedral shape, and thus, repeated description will be omitted. The molds 10 have an external shape corresponding to the shape of the hollow portions 111.

Next, the plurality of molds 10 are arranged to correspond to a set, three-dimensional pattern in operation S120. Here also, as described above, the set three-dimensional pattern may be in various forms including a hexahedral shape, and repeated description thereof will be omitted.

As the molds 10 are arranged in the set three-dimensional pattern, the plurality of molds 10 are supported by and connected to one another via a plurality of connectors 20 in operation S130. Here, the connectors 20 may be, for example, tensioned strings or pins, but are not limited thereto.

The tensioned strings or pins may be fixed to a cast (not shown) formed outside the cladding 120 during the manufacturing process and a tension may be applied to the strings or the pins. Meanwhile, while the connectors 20 such as tensioned strings or pins that are passed through the molds 10 are illustrated in FIGS. 13 and 14, this is exemplary, and the molds 10 may also be connected to the connectors 20 such as strings or pins by using an auxiliary bonding material such as a Velcro at corner portions of the molds 10.

Next, the cell walls 113 are formed by filling spaces between the molds 10 with a fluid material that is suitable for the purpose, and the cell walls 113 are cured to complete the hollow structure 210 in operation S140. The fluid material for forming the cell walls 113 may be any material as long as a stress may be structurally maintained. That is, the cell walls 113 may be formed of concrete, a ceramic, a synthetic resin material, or a metal. Also, according to necessity, a stiffener such as a reinforcing bar or a reinforcing fiber that is arranged for reinforcement may be used as a fluid material to fill the spaces. Finally, the cladding 120 surrounding the outside of the hollow structure 210 is formed in operation S150. The cladding 120 may also be formed of any material as long as a stress may be structurally maintained. That is, the cladding 120 may be formed of concrete, a ceramic, a synthetic resin material, or a metal, and a stiffener such as a reinforcing bar or a reinforcing fiber that is arranged for reinforcement may be used to form the cladding 120 according to necessity.

According to the method of manufacturing the storage container according to the embodiment of the prevent invention as described above (operations S110 through S150), the storage container 200 according to another embodiment of the present invention is completed as illustrated in FIG. 17 is completed.

The storage structure 200 according to the above-described embodiment of the present invention includes the hollow structure 210.

The hollow structure 210 is essentially included for the manufacture, and further includes a plurality of molds 10 that respectively tightly contact the cell walls 113 by surface contact.

The molds 10 may preferably be formed of a soft, flexible material such as a plastic or an inflated vinyl, but is not limited thereto.

Also, the hollow structure 210 may further include a plurality of connectors 20 that pass through the cell walls 113 to respectively connect and support the plurality of molds 10. Here also, tensioned strings or pins may be used as the connectors 20, but the connectors 20 are not limited thereto.

Figure 15:
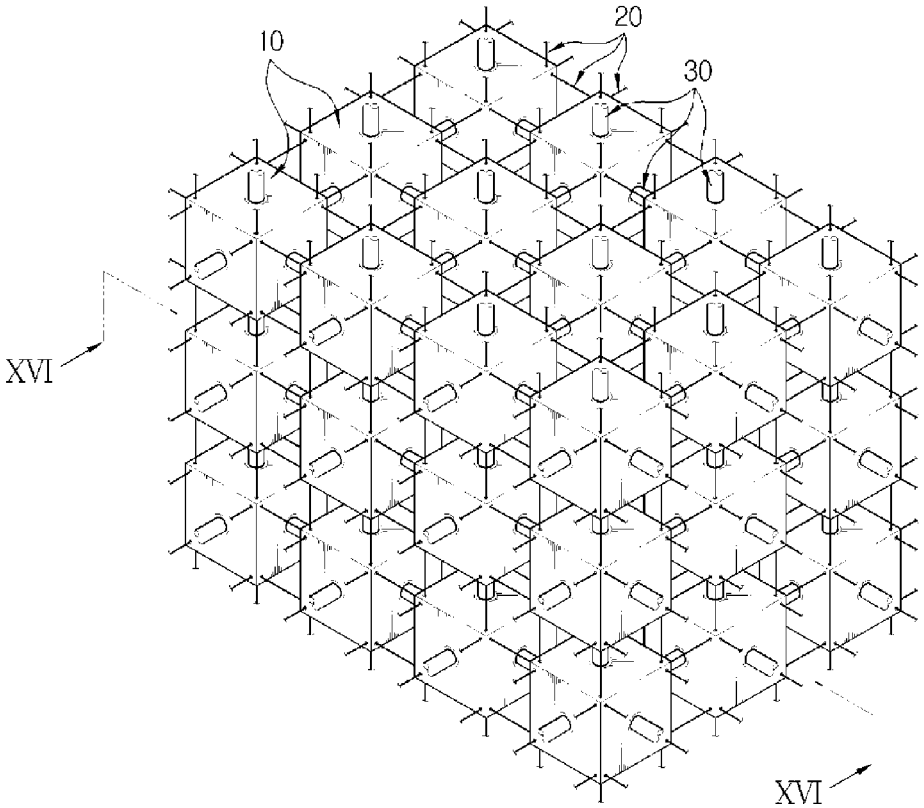
FIG. 15 is a perspective view illustrating an operation of connecting molds in the method of manufacturing a nuclear power plant container structure illustrated in FIG. 12.
Figure 16:
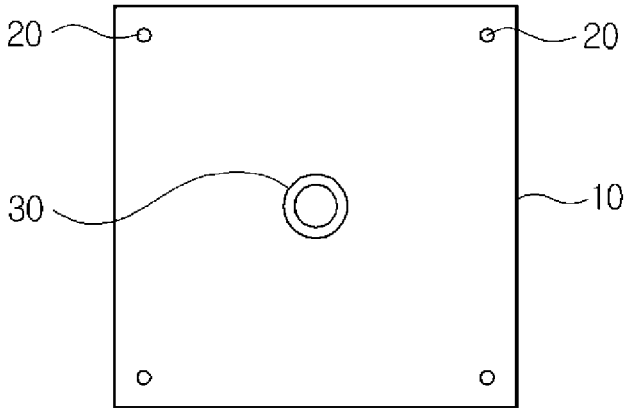
FIG. 16 is a cross-sectional view cut along a line XII-XII of FIG. 15.
Figure 18:
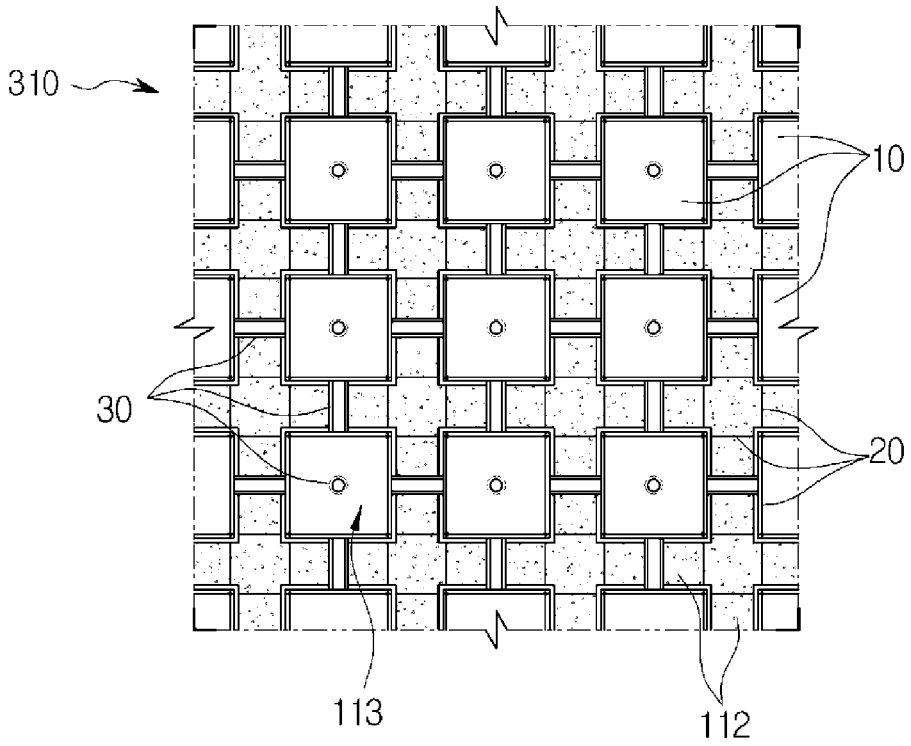
FIG. 18 illustrates a nuclear power plant container structure according to another embodiment of the present invention, which is manufactured by using the method of manufacturing of FIGS. 15 and 16.
Figure 19:
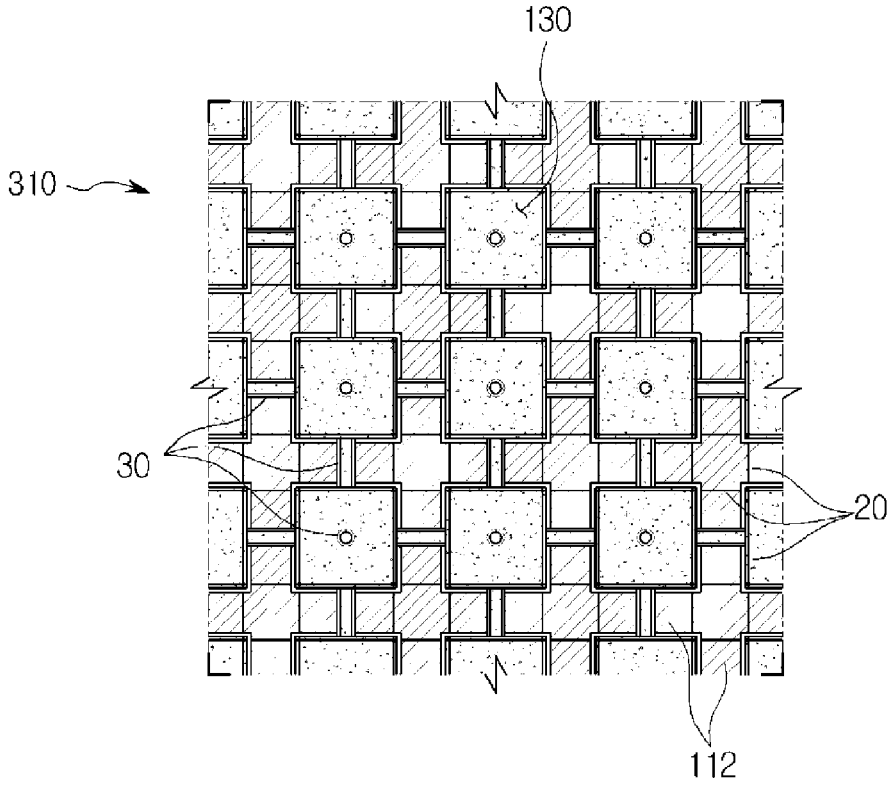
FIG. 19 is a cross-sectional view illustrating the nuclear power plant container structure of FIG. 18, in which a fluid is filled in cells.

Meanwhile, FIG. 15 is a perspective view illustrating an operation of connecting molds in the method of manufacturing a storage structure illustrated in FIG. 12. FIG. 16 is a cross-sectional view cut along a line XVI-XVI of FIG. 15. FIG. 18 illustrates a storage structure according to another embodiment of the present invention, which is manufactured by using the method of manufacturing of FIGS. 15 and 16. FIG. 19 is a cross-sectional view illustrating the storage structure of FIG. 18, in which a fluid is filled in cells. Here, like reference numerals as in those of FIGS. 1 through 16 and FIG. 12 denote like elements that have the same structure and perform the same function, and thus repeated description thereof will be omitted.

In the method of manufacturing a storage structure according to the embodiment of the present invention as described above (operations S110 through S150), the plurality of molds 10 that are arranged in a three-dimensional pattern may be fluidly connected to one another by using a plurality of tubes 30 in operation S161. The tubes 30 may preferably be formed of a soft material. Also, the tubes 30 function as a path through which the fluid 130, which is to be described later, is filled.

According to the method of manufacturing a storage structure as described above (operations S110 through S161), the storage container 300 according to another embodiment of the present invention as illustrated in FIG. 14 is completed.

The storage container 300 according to the above-described embodiment of the present invention includes a hollow structure 310. The hollow structure 310 further includes at least one tube 30 that is inserted into a connection hole 114.

According to the method of manufacturing a storage structure as described above (operations S110 through S161), a fluid 130 having a functionality may be filled in each of the hollow portions 111 formed in the plurality of cells 112 in operation S162. Examples of the fluid 130 having a functionality include not only water but also a liquid or a gas containing a functional additive, according to necessity.

According to the method of manufacturing a storage container (operations S110 through S162) as described above, a storage container as illustrated in FIG. 19 is completed. In the hollow structure 310 of the storage container as described above, each of the hollow portions 111 in the cells 112 are filled with a fluid having a functionality.

Meanwhile, according to the present invention, a method of manufacturing the storage structure 100 in which the cell walls 113 formed as a single unit is disclosed. However, the cell walls 113 formed as a single unit are exemplary. A nuclear power plant container structure, which is manufactured as a huge structure may also be manufactured in situ. In more detail, instead of placing all molds at a time and then performing depositing at a time, a storage structure may be constructed by using a layer-by-layer method in which a foundation of the storage structure and vertical walls are stacked layer by layer, and then a part corresponding to a roof is finally manufactured.

As described above, according to the storage container of the embodiments of the present invention, as a plurality of cells are partitioned by cell walls, and hollow portions are formed in the cells, paths through which cracks develop may be complicated so that the damage extent may be minimized in the case when the storage structure is damaged due to impacts by internal and external factors. Also, the hollow portions of the cell walls are filled with a fluid or lead so as to effectively block leakage of radioactivity. At normal times, a boron solution filled in the hollow portions of the cells of an inner portion may be circulated by using a pump so as to cool the storage container for nuclear waste. In addition, if the nuclear waste storage container structure is damaged due to an earthquake or in an emergency, the boron solution and lead are poured out to delay nuclear reactions, thereby minimizing leakage of radioactivity.

While the present invention has been particularly shown and described with reference to exemplary embodiments thereof, it will be understood by those of ordinary skill in the art that various changes in form and details may be made therein without departing from the spirit and scope of the present invention as defined by the following claims.

The present invention is produced by nuclear power plants can be safely store nuclear waste can be used in building structures.

The invention claimed is:

1. A nuclear power plant container structure comprising:

a hollow structure forming an inner space for tightly sealing radioactive waste therein, said hollow structure comprising a plurality of hollow cells which are partitioned by cell walls and arranged in a three-dimensional pattern to form the inner space;

a cladding for surrounding the outside of the hollow structure; and a filler that is selectively filled in hollow portions of the cells, and can suppress one of nuclear reactions of the radioactive waste or block radioactivity radiated from the radioactive waste, wherein at least one connection hole is formed in each of the cell walls, and each hollow portion formed in the respective hollow cells is fluidly connected with neighboring hollow portions through the at least one connection hole.

2. The nuclear power plant container structure of claim 1, wherein the filler is a fluid containing at least one of cooling water and boron (Br) solution.

3. The nuclear power plant container structure of claim 1, further comprising:

a first storage tank installed adjacent to the hollow structure and storing a filler; and a circulation pump connected to the first storage tank to circulate the filler through the hollow portions.

4. The nuclear power plant container structure of claim 3, further comprising:

a second storage tank installed in a remote place from the hollow structure and storing the filler; and a supply pump that is connected to the second storage tank to circulate the filler through the hollow portions when the circulation pump is not able to operate.

5. The nuclear power plant container structure of claim 1, further comprising:

a temperature sensor that senses an internal temperature of the hollow structure; and an ejection nozzle, installed at an inner wall of the hollow structure, is fluidly connected to the hollow portions of the cells filled with the fluid, and selectively ejects the fluid towards the radioactive waste according to an internal temperature of the hollow structure sensed by using the temperature sensor.

6. The nuclear power plant container structure of claim 1, wherein the filler comprises lead (Pb).

7. The nuclear power plant container structure of claim 1, wherein the filler is a fluid containing cooling water and/or boron (Br) solution, wherein the fluid is filled in the hollow portions of the cells disposed in an inner portion of the hollow structure to be adjacent to the radioactive waste, wherein the lead (Pb) is filled in the hollow portions of the cells arranged in an outer portion of the hollow structure not filled with the fluid.

8. The nuclear power plant container structure of claim 7, further comprising:

a first storage tank installed adjacent to the hollow structure and storing the filler; and a circulation pump connected to the first storage tank to circulate the filler through the hollow portions.

9. The nuclear power plant container structure of claim 8, further comprising:

a second storage tank installed in a remote place from the hollow structure and storing the filler; and a supply pump connected to the second storage tank to circulate the filler through the hollow portions, when the circulation pump is not able to operate.

10. The nuclear power plant container structure of claim 6, further comprising:

a temperature sensor that senses an internal temperature of the hollow structure; and an ejection nozzle, installed at an inner wall of the hollow structure, is fluidly connected to the hollow portions of the cells filled with the fluid, and selectively ejects the fluid towards the radioactive waste according to an internal temperature of the hollow structure sensed by using the temperature sensor.

11. The nuclear power plant container structure of claim 1, further comprising:

a plurality of tubes inserted into the at least one connection hole.

12. The nuclear power plant container structure of claim 1, wherein the hollow structure is arranged in a three-dimensional pattern in the form of a dome or an arch.

13. The nuclear power plant container structure of claim 1, wherein the hollow cells have a cross-section having a form selected from the group consisting of a circle, an oval, a polygon, and a closed shape formed by combining a curve and a straight line.

14. The nuclear power plant container structure of claim 1, further comprising:

a plurality of molds that tightly contact the plurality of inner walls of the cells by surface contact.

15. The nuclear power plant container structure of claim 14, further comprising:

a plurality of connectors that pass through the cell walls to connect and support the plurality of molds.

16. The nuclear power plant container structure of claim 14, wherein the molds are formed of a soft material having flexibility.

17. The nuclear power plant container structure of claim 16, wherein the molds are formed of a plastic or an inflated vinyl.

* * * * *